US011096493B1

(12) United States Patent
Tsai

(10) Patent No.: US 11,096,493 B1
(45) Date of Patent: Aug. 24, 2021

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 17/029,077

(22) Filed: Sep. 23, 2020

(51) Int. Cl.
*A47C 4/28* (2006.01)

(52) U.S. Cl.
CPC ..... *A47C 4/286* (2013.01)

(58) Field of Classification Search
CPC ..... A47C 4/286
USPC ..... 297/16.1
See application file for complete search history.

(56) References Cited

U.S. PATENT DOCUMENTS 10,631,648 B1 * 4/2020 Tsai ..... A47C 4/286
10,660,443 B1 * 5/2020 Tsai ..... A47C 4/286
2015/0359339 A1 * 12/2015 Choi ..... A47C 4/286 297/35
2016/0100688 A1 * 4/2016 Grace ..... A47C 4/286 297/17

* cited by examiner

*Primary Examiner* — Anthony D Barfield

(57) ABSTRACT

A folding chair includes a left frame rod, right frame rod, front left leg rod, front right leg rod, left armrest rod, right armrest rod, left armrest supporting rod, right armrest supporting rod, left connecting rod, right connecting rod, left backrest rod, right backrest rod, first front supporting rod, second front supporting rod, first rear supporting rod, second rear supporting rod, left frame rotating component, right frame rotating component, left positioning slider, right positioning slider, left sliding component, right sliding component, left armrest fixing component, right armrest fixing component, left supporting rod sliding component, right supporting rod sliding component, leg shoes, backrest rod sliding components, front limiting components, seat portion and backrest portion.

16 Claims, 4 Drawing Sheets

FOLDING CHAIR

BACKGROUND OF THE INVENTION

1. Field of the Invention

The present disclosure relates to folding chairs, and in particular to a folding chair capable of being folded to store and unfolded to use.

2. Description of the Related Art

A conventional folding chair consists of a frame, two legs, a seat and a backrest. The legs movably cross the frame and fit thereto. The seat movably fits to the frame. The backrest fits to the top end of the frame. Therefore, the legs and the seat can be unfolded on one side of the frame to allow a user to sit on the seat or allow the legs and the seat to rest against the frame.

However, the legs and the seat rest against the frame in order for the conventional folding chair to be folded, and thereafter the width of the frame and the width of the seat are still the same as their widths are when the conventional folding chair is unfolded, thereby causing the conventional folding chair to take up much space and be difficult to carry. Furthermore, when the folding chair is unfolded, only the bottom of the frame, the legs, and the ground provide support to the unfolded folding chair, and thus the unfolded folding chair is neither stable nor sturdy.

Therefore, it is important to devise a folding chair which can be folded to become bundle-shaped so as to be space-saving and portable and unfolded to become stable and sturdy.

BRIEF SUMMARY OF THE INVENTION

An objective of the present disclosure is to provide a folding chair which can be folded to become bundle-shaped so as to be space-saving and portable and unfolded to become stable and sturdy.

To achieve at least the above objective, the present disclosure provides a folding chair which comprises a left frame rod, a right frame rod, a front left leg rod, a front right leg rod, a left armrest rod, a right armrest rod, a left armrest supporting rod, a right armrest supporting rod, a left connecting rod, a right connecting rod, a left backrest rod, a right backrest rod, a first front supporting rod, a second front supporting rod, a first rear supporting rod, a second rear supporting rod, a left frame rotating component, a right frame rotating component, a left positioning slider, a right positioning slider, a left sliding component, a right sliding component, a left armrest fixing component, a right armrest fixing component, a front left leg shoe, a front right leg shoe, a left supporting rod sliding component, a right supporting rod sliding component, a rear left leg shoe, a rear right leg shoe, a left backrest rod sliding component, a right backrest rod sliding component, a front left limiting component, a front right limiting component, a seat portion and a backrest portion. The left frame rotating component is movably coupled to the vicinity of one end of the left frame rod and is movably coupled to the left armrest supporting rod. The other end of the left frame rod is movably coupled to the rear left leg shoe. The left positioning slider and the left sliding component are movably coupled to between the two ends of the left frame rod. One end of the front left leg rod is movably coupled to the front left leg shoe. The other end of the front left leg rod is movably coupled to the left backrest rod sliding component. The left positioning slider is movably coupled to between the two ends of the front left leg rod. One end of the left armrest rod is movably coupled to the left backrest rod. The other end of the left armrest rod is disposed at the left armrest fixing component. One end of the left armrest supporting rod is movably coupled to the left armrest fixing component. The other end of the left armrest supporting rod is movably coupled to the left supporting rod sliding component. One end of the left connecting rod is movably coupled to the left sliding component. The other end of the left connecting rod is movably coupled to the front left leg rod. The front left leg rod is movably penetratingly disposed at the left supporting rod sliding component. The left backrest rod is movably penetratingly disposed at the left backrest rod sliding component. One end of the left backrest rod is movably coupled to the left sliding component. The front left limiting component is disposed at the left armrest supporting rod and thus pressed against by the left frame rotating component. The right frame rotating component is movably coupled to the vicinity of one end of the right frame rod and movably coupled to the right armrest supporting rod. The other end of the right frame rod is movably coupled to the rear right leg shoe. The right positioning slider and the right sliding component are movably coupled to between the two ends of the right frame rod. One end of the front right leg rod is movably coupled to the front right leg shoe. The other end of the front right leg rod is movably coupled to the right backrest rod sliding component. The right positioning slider is movably coupled to between the two ends of the front right leg rod. One end of the right armrest rod is movably coupled to the right backrest rod. The other end of the right armrest rod is disposed at the right armrest fixing component. One end of the right armrest supporting rod is movably coupled to the right armrest fixing component. The other end of the right armrest supporting rod is movably coupled to the right supporting rod sliding component. One end of the right connecting rod is movably coupled to the right sliding component. The other end of the right connecting rod is movably coupled to the front right leg rod. The front right leg rod is movably penetratingly disposed at the right supporting rod sliding component. The right backrest rod is movably penetratingly disposed at the right backrest rod sliding component. One end of the right backrest rod is movably coupled to the right sliding component. The front right limiting component is disposed at the right armrest supporting rod and thus pressed against by the right frame rotating component. The first front supporting rod and the second front supporting rod cross each other and are movably coupled together. One end of the first front supporting rod is movably coupled to the left frame rotating component. The other end of the first front supporting rod is movably coupled to the front right leg shoe. One end of the second front supporting rod is movably coupled to the right frame rotating component. The other end of the second front supporting rod is movably coupled to the front left leg shoe. The first rear supporting rod and the second rear supporting rod cross each other and are movably coupled together. One end of the first rear supporting rod is movably coupled to the left backrest rod sliding component. The other end of the first rear supporting rod is movably coupled to the rear right leg shoe. One end of the second rear supporting rod is movably coupled to the right backrest rod sliding component. The other end of the second rear supporting rod is movably coupled to the rear left leg shoe. The seat portion is disposed at the left frame rod and the right frame rod. The backrest portion is disposed at the left backrest rod and the right backrest rod.

In an embodiment of the folding chair, the left frame rotating component has a first pivotal portion, a first spanning portion and a first fitting portion. The first spanning portion is disposed on the top surface of the first pivotal portion. The first fitting portion is disposed on one side of the first pivotal portion. One end of the first front supporting rod is movably coupled to the first pivotal portion. The left frame rod is movably coupled to the first spanning portion. The left armrest supporting rod is movably penetratingly disposed at the first fitting portion. The first fitting portion rests against the front left limiting component.

In an embodiment of the folding chair, the left sliding component has a second fitting portion, a second pivotal portion and a third pivotal portion. The second pivotal portion is disposed on one side of the second fitting portion. The third pivotal portion is disposed at the bottom of the second fitting portion. The left frame rod is movably coupled to the second fitting portion. One end of the left connecting rod is movably coupled to the second pivotal portion. One end of the left backrest rod is movably coupled to the third pivotal portion.

In an embodiment of the folding chair, the front left leg shoe has a fourth pivotal portion and a fifth pivotal portion. The fourth pivotal portion and the fifth pivotal portion are adjacent to each other. One end of the front left leg rod is movably coupled to the fourth pivotal portion. The other end of the second front supporting rod is movably coupled to the fifth pivotal portion.

In an embodiment of the folding chair, the rear left leg shoe has a sixth pivotal portion and a seventh pivotal portion. The sixth pivotal portion and the seventh pivotal portion are adjacent to each other. The other end of the left frame rod is movably coupled to the sixth pivotal portion. The other end of the second rear supporting rod is movably coupled to the seventh pivotal portion.

In an embodiment of the folding chair, the left backrest rod sliding component has a third fitting portion, an eighth pivotal portion and a ninth pivotal portion. The eighth pivotal portion is disposed on one side of the third fitting portion. The ninth pivotal portion is disposed on the other side of the third fitting portion. The other end of the front left leg rod is movably coupled to the eighth pivotal portion. The left backrest rod is movably penetratingly disposed at the third fitting portion. One end of the first rear supporting rod is movably coupled to the ninth pivotal portion.

In an embodiment of the folding chair, the front left limiting component is pivotally connected to a front left connecting rod and thus movably coupled to between the two ends of the left frame rod.

In an embodiment of the folding chair, a left blocking member is disposed at the two ends of the left frame rod to block the left sliding component.

In an embodiment of the folding chair, the right frame rotating component has a tenth pivotal portion, a second spanning portion and a fourth fitting portion. The second spanning portion is disposed on the top surface of the tenth pivotal portion. The fourth fitting portion is disposed on one side of the tenth pivotal portion. One end of the second front supporting rod is movably coupled to the tenth pivotal portion. The right frame rod is movably coupled to the second spanning portion. The right armrest supporting rod is movably penetratingly disposed at the fourth fitting portion. The fourth fitting portion rests against the front right limiting component.

In an embodiment of the folding chair, the right sliding component has a fifth fitting portion, an eleventh pivotal portion and a twelfth pivotal portion. The eleventh pivotal portion is disposed on one side of the fifth fitting portion. The twelfth pivotal portion is disposed at the bottom of the fifth fitting portion. The right frame rod is movably coupled to the fifth fitting portion. One end of the right connecting rod is movably coupled to the eleventh pivotal portion. One end of the right backrest rod is movably coupled to the twelfth pivotal portion.

In an embodiment of the folding chair, the front right leg shoe has a thirteenth pivotal portion and a fourteenth pivotal portion. The thirteenth pivotal portion and the fourteenth pivotal portion are adjacent to each other. One end of the front right leg rod is movably coupled to the thirteenth pivotal portion. The other end of the first front supporting rod is movably coupled to the fourteenth pivotal portion.

In an embodiment of the folding chair, the rear right leg shoe has a fifteenth pivotal portion and a sixteenth pivotal portion. The fifteenth pivotal portion and the sixteenth pivotal portion are adjacent to each other. The other end of the right frame rod is movably coupled to the fifteenth pivotal portion. The other end of the first rear supporting rod is movably coupled to the sixteenth pivotal portion.

In an embodiment of the folding chair, the right backrest rod sliding component has a sixth fitting portion, a seventeenth pivotal portion and an eighteenth pivotal portion. The seventeenth pivotal portion is disposed on one side of the sixth fitting portion. The eighteenth pivotal portion is disposed on the other side of the sixth fitting portion. The other end of the front right leg rod is movably coupled to the seventeenth pivotal portion. The right backrest rod is movably penetratingly disposed at the sixth fitting portion. One end of the second rear supporting rod is movably coupled to the eighteenth pivotal portion.

In an embodiment of the folding chair, the front right limiting component is pivotally connected to a front right connecting rod and thus movably coupled to between the two ends of the right frame rod.

In an embodiment of the folding chair, a right blocking member is disposed between the two ends of the right frame rod to block the right sliding component.

In an embodiment of the folding chair, the backrest portion and the seat portion are connected.

Therefore, the folding chair of the present disclosure can be folded to become bundle-shaped so as to be space-saving and portable and unfolded to become stable and sturdy.

DETAILED DESCRIPTION OF THE INVENTION

Figure 1:
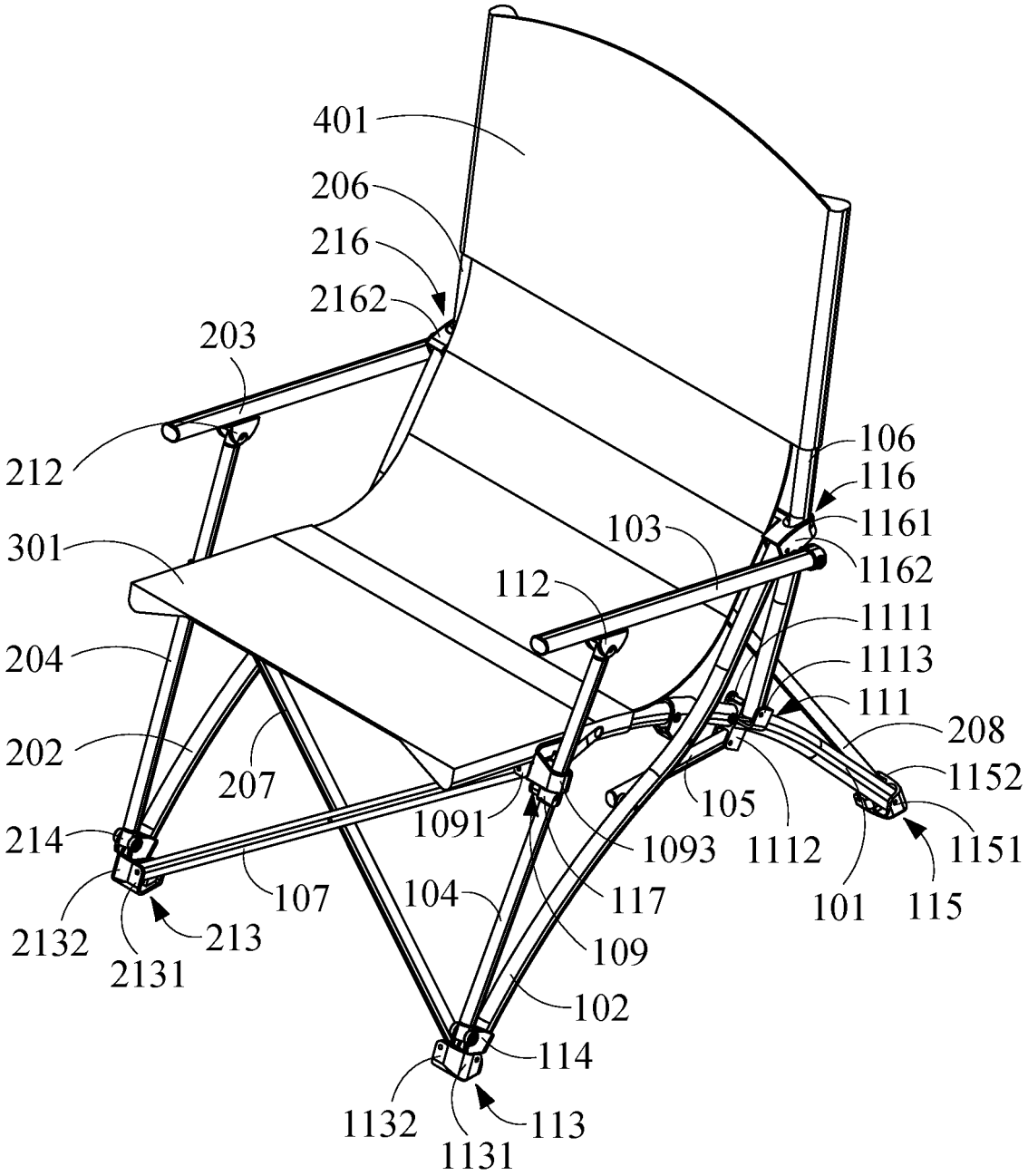
FIG. 1 is a schematic view of a folding chair unfolded according to the present disclosure.

To facilitate understanding of the object, characteristics and effects of this present disclosure, embodiments together with the attached drawings for the detailed description of the present disclosure are provided.

Referring to FIG. 1 through FIG. 4, the present disclosure provides a folding chair which comprises a left frame rod 101, a right frame rod 201, a front left leg rod 102, a front right leg rod 202, a left armrest rod 103, a right armrest rod 203, a left armrest supporting rod 104, a right armrest supporting rod 204, a left connecting rod 105, a right connecting rod 205, a left backrest rod 106, a right backrest rod 206, a first front supporting rod 107, a second front supporting rod 207, a first rear supporting rod 108, a second rear supporting rod 208, a left frame rotating component 109, a right frame rotating component 209, a left positioning slider 110, a right positioning slider 210, a left sliding component 111, a right sliding component 211, a left armrest fixing component 112, a right armrest fixing component 212, a front left leg shoe 113, a front right leg shoe 213, a left supporting rod sliding component 114, a right supporting rod sliding component 214, a rear left leg shoe 115, a rear right leg shoe 215, a left backrest rod sliding component 116, a right backrest rod sliding component 216, a front left limiting component 117, a front right limiting component 217, a seat portion 301 and a backrest portion 401.

The left frame rotating component 109 is movably coupled to the vicinity of one end of the left frame rod 101 and movably coupled to the left armrest supporting rod 104. The other end of the left frame rod 101 is movably coupled to the rear left leg shoe 115. The left positioning slider 110 and the left sliding component 111 are movably coupled to between the two ends of the left frame rod 101. One end of the front left leg rod 102 is movably coupled to the front left leg shoe 113. The other end of the front left leg rod 102 is movably coupled to the left backrest rod sliding component 116. The left positioning slider 110 is movably coupled to between the two ends of the front left leg rod 102. One end of the left armrest rod 103 is movably coupled to the left backrest rod 106. The other end of the left armrest rod 103 is disposed at the left armrest fixing component 112. One end of the left armrest supporting rod 104 is movably coupled to the left armrest fixing component 112. The other end of the left armrest supporting rod 104 is movably coupled to the left supporting rod sliding component 114. One end of the left connecting rod 105 is movably coupled to the left sliding component 111. The other end of the left connecting rod 105 is movably coupled to the front left leg rod 102. The front left leg rod 102 is movably penetratingly disposed at the left supporting rod sliding component 114. The left backrest rod 106 is movably penetratingly disposed at the left backrest rod sliding component 116. One end of the left backrest rod 106 is movably coupled to the left sliding component 111. The front left limiting component 115 is disposed at the left armrest supporting rod 104 and thus pressed against by the left frame rotating component 109.

The right frame rotating component 209 is movably coupled to the vicinity of one end of the right frame rod 201 and movably coupled to the right armrest supporting rod 204. The other end of the right frame rod 201 is movably coupled to the rear right leg shoe 215. The right positioning slider 216 and the right sliding component 211 are movably coupled to between the two ends of the right frame rod 201. One end of the front right leg rod 202 is movably coupled to the front right leg shoe 213. The other end of the front right leg rod 202 is movably coupled to the right backrest rod sliding component 216. The right positioning slider 216 is movably coupled to between the two ends of the front right leg rod 202. One end of the right armrest rod 203 is movably coupled to the right backrest rod 206. The other end of the right armrest rod 203 is disposed at the right armrest fixing component 212. One end of the right armrest supporting rod 204 is movably coupled to the right armrest fixing component 212. The other end of the right armrest supporting rod 204 is movably coupled to the right supporting rod sliding component 214. One end of the right connecting rod 205 is movably coupled to the right sliding component 211. The other end of the right connecting rod 205 is movably coupled to the front right leg rod 202. The front right leg rod 202 is movably penetratingly disposed at the right supporting rod sliding component 214. The right backrest rod 206 is movably penetratingly disposed at the right backrest rod sliding component 216. One end of the right backrest rod 206 is movably coupled to the right sliding component 211. The front right limiting component 215 is disposed at the right armrest supporting rod 204 and thus pressed against by the right frame rotating component 209.

The first front supporting rod 107 and the second front supporting rod 207 cross each other and are movably coupled together. One end of the first front supporting rod 107 is movably coupled to the left frame rotating component 109. The other end of the first front supporting rod 107 is movably coupled to the front right leg shoe 213. One end of the second front supporting rod 207 is movably coupled to the right frame rotating component 209. The other end of the second front supporting rod 207 is movably coupled to the front left leg shoe 113.

The first rear supporting rod 108 and the second rear supporting rod 208 cross each other and are movably coupled together. One end of the first rear supporting rod 108 is movably coupled to the left backrest rod sliding component 116. The other end of the first rear supporting rod 108 is movably coupled to the rear right leg shoe 215. One end of the second rear supporting rod 208 is movably coupled to the right backrest rod sliding component 216. The other end of the second rear supporting rod 208 is movably coupled to the rear left leg shoe 115.

The seat portion 301 is disposed at the left frame rod 101 and the right frame rod 201. The backrest portion 401 is disposed at the left backrest rod 106 and the right backrest rod 206. Therefore, the user can sit on the seat portion 301 and rest his or her back against the backrest portion 401 to increase sitting comfortability (as shown in FIG. 1). The backrest portion 401 and the seat portion 301 are connected, thereby increasing sitting stability.

Figure 2:
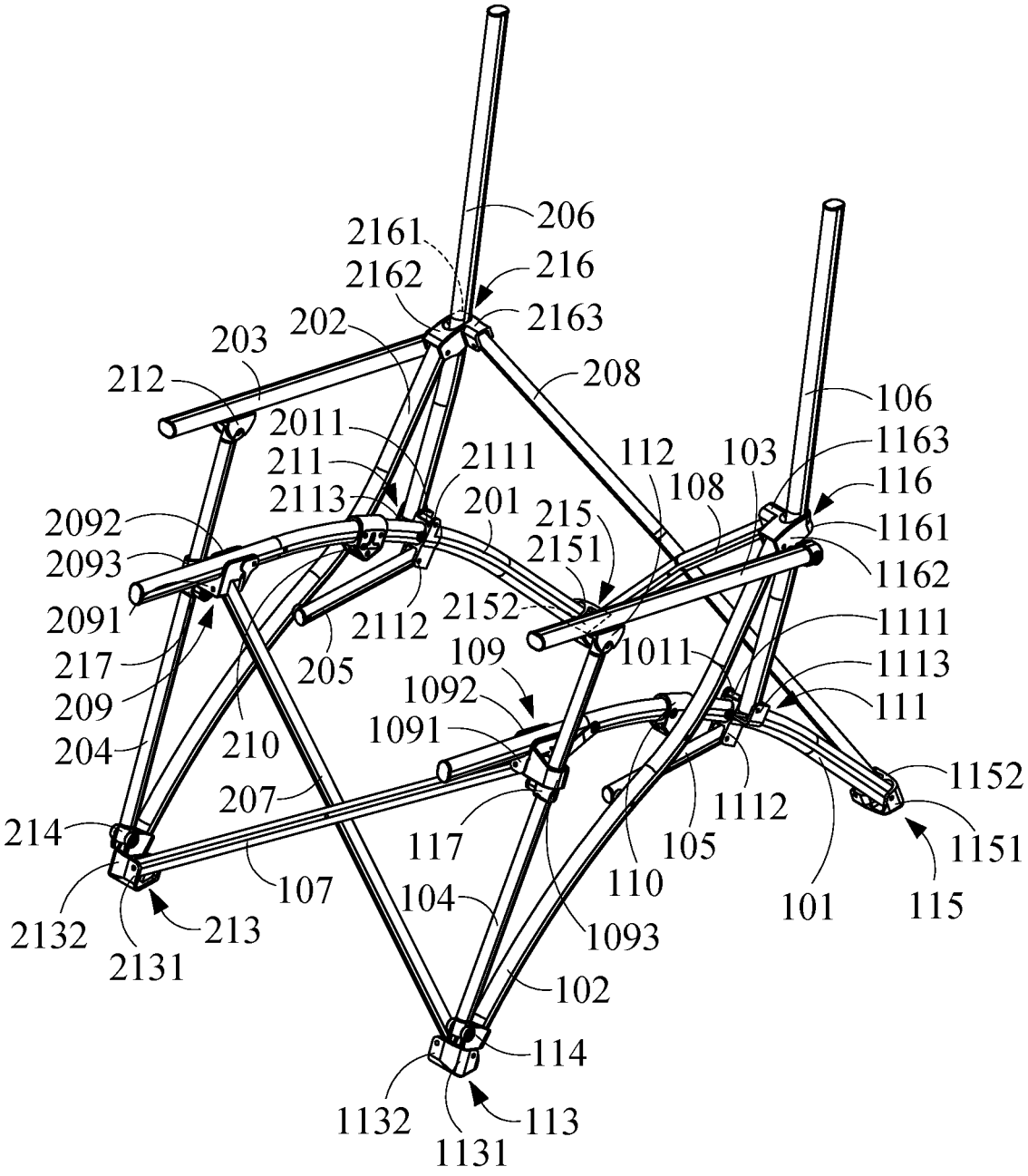
FIG. 2 is a schematic view of the folding chair unfolded according to the present disclosure, without showing a seat portion and a backrest portion.
Figure 3:
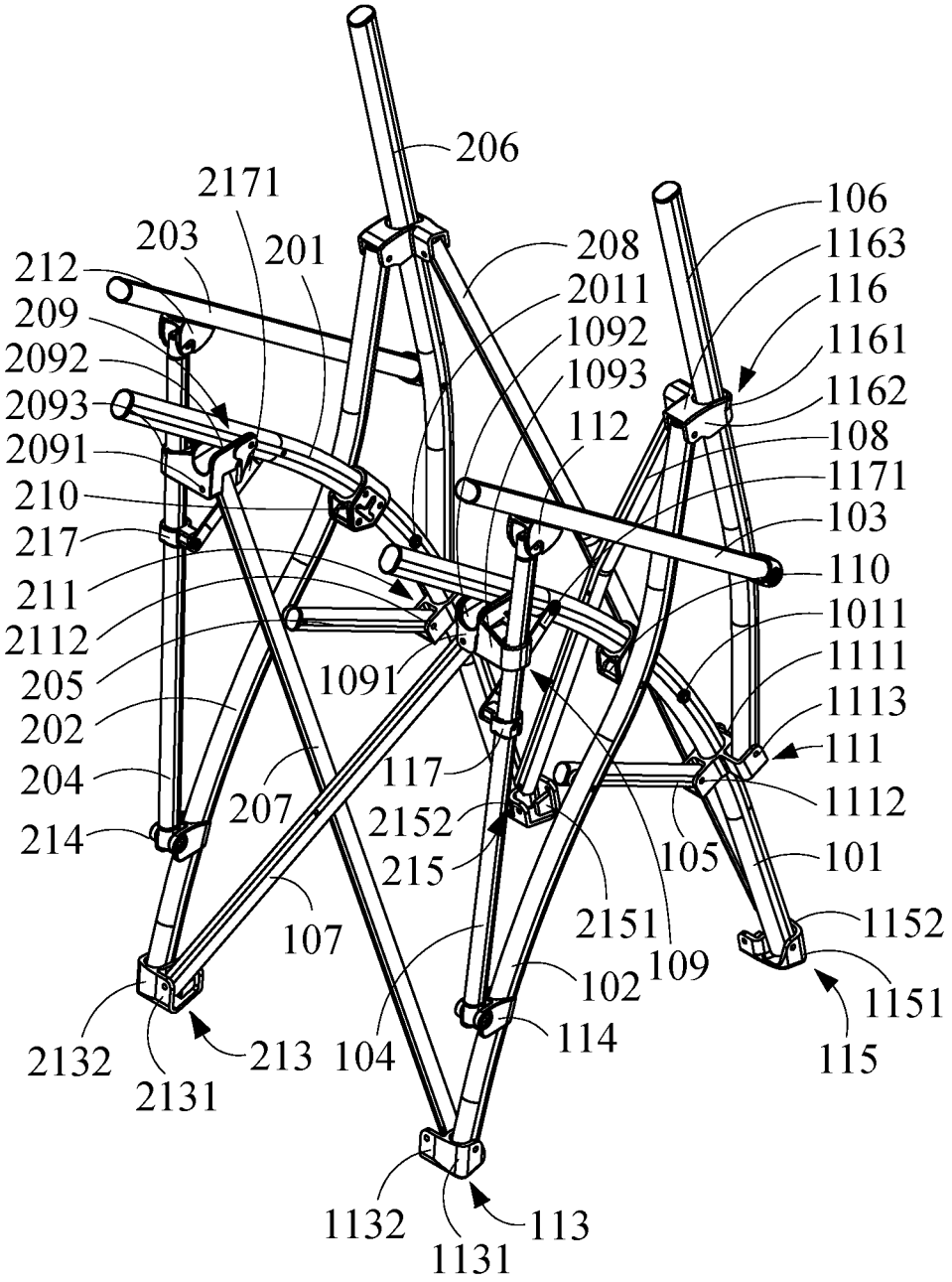
FIG. 3 is a first schematic view of the folding chair folded according to the present disclosure, without showing a seat portion and a backrest portion.
Figure 4:
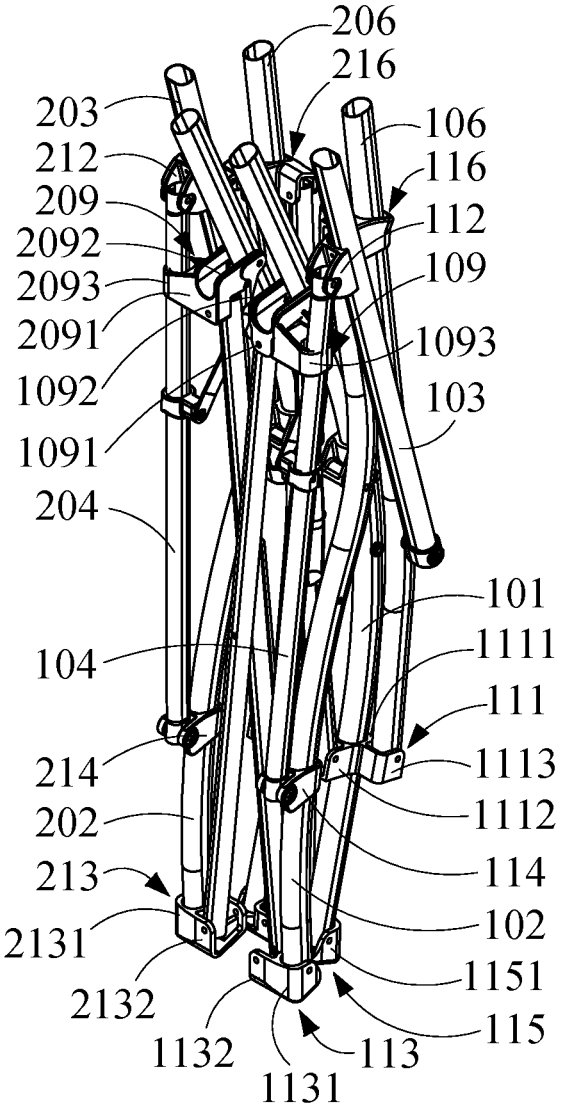
FIG. 4 is a second schematic view of the folding chair folded according to the present disclosure, without showing a seat portion and a backrest portion.

As shown in FIG. 2 through FIG. 4, to fold the folding chair of the present disclosure, the user holds one end of the left backrest rod 106 (or the right backrest rod 206) while holding one end of the left frame rod 101 (or the right frame rod 201), moves the left frame rod 101 toward the left backrest rod 106 to cause the left frame rod 101 to move out of the left frame rotating component 109 and rotate relative to the left frame rotating component 109 and the rear left leg shoe 115. Thus, not only does the left frame rod 101 cause the left positioning slider 110 to move, but the left positioning slider 110 also allows the front left leg rod 102 to drive the movement of the left connecting rod 105. As a result, the left connecting rod 105 drives the front left limiting component 117 downward, causing the left armrest rod 111 to move toward the left backrest rod 106. Consequently, the left armrest rod 111 pulls the left armrest supporting rod 113 with the left armrest fixing component 112, such that the left armrest supporting rod 113 moves upward because of the left supporting rod sliding component 114 to not only allow the left frame rotating component 109 to separate from one side of the front left limiting component 117 but also cause the left backrest rod sliding component 116 to move upward relative to the left backrest rod 106; hence, the first front supporting rod 107 drives the front right leg shoe 213 toward the front left leg shoe 113. At this moment, the upward movement of the left backrest rod sliding component 116 causes the first rear supporting rod 108 and the rear right leg shoe 215 to move toward the left backrest rod 106.

Afterward, the right frame rod 201 moves toward the right backrest rod 206, such that the right frame rod 201 moves out of the right frame rotating component 209 and rotates relative to the right frame rotating component 209, allowing the right frame rod 201 to rotate relative to the rear right leg shoe 215. Thus, the right frame rod 201 not only causes the right positioning slider 210 to move but also causes the front right leg rod 202 to drive the movement of the right connecting rod 205 because of the right positioning slider 210; meanwhile, the right connecting rod 205 drives the front right limiting component 217 downward and thus drives the right armrest rod 211 toward the right backrest rod 206. Consequently, the right armrest rod 211 pulls the right armrest supporting rod 213 with the right armrest fixing component 212, such that the right armrest supporting rod 213 moves upward because of the right supporting rod sliding component 214 to not only allow the right frame rotating component 209 to separate from one side of the front right limiting component 217 but also cause the right backrest rod sliding component 216 to move upward relative to the right backrest rod 206. Consequently, the second front supporting rod 207 drives the front left leg shoe 113 toward the front right leg shoe 213; meanwhile, the upward movement of the right backrest rod sliding component 216 causes the second rear supporting rod 208 and the rear left leg shoe 115 to move toward the right backrest rod 206. Therefore, the folding chair of the present disclosure can be folded to become bundle-shaped so as to be space-saving and portable.

Both the folding process and the unfolding process of the folding chair of the present disclosure are rendered efficient by protecting the front left leg rod 102, the second front supporting rod 207, the left frame rod 101, the second rear supporting rod 208, the front right leg rod 202, the first front supporting rod 107, the right frame rod 201 and the first rear supporting rod 108 with the front left leg shoe 113, the rear left leg shoe 115, the front right leg shoe 213 and the rear right leg shoe 215, respectively, to prevent the folding chair of the present disclosure from coming into direct contact with the ground and thus getting damaged, prevent the folding chair of the present disclosure from sliding, and enable the folding chair of the present disclosure to be stable and sturdy.

In an embodiment of the present disclosure, as shown in FIG. 2 through FIG. 4, the left frame rotating component 109 has a first pivotal portion 1091, a first spanning portion 1092 and a first fitting portion 1093. The first spanning portion 1092 is disposed on the top surface of the first pivotal portion 1091. The first fitting portion 1093 is disposed on one side of the first pivotal portion 1091. One end of the first front supporting rod 107 is movably coupled to the first pivotal portion 1091. The left frame rod 101 is movably coupled to the first spanning portion 1092. The left armrest supporting rod 104 is movably penetratingly disposed at the first fitting portion 1093. The first fitting portion 1093 rests against the front left limiting component 117. Therefore, to unfold the folding chair, the user moves the left frame rod 101 into or out of the first spanning portion 1092, uses the first pivotal portion 1091 of the left frame rotating component 109 to actuate the movement of the first front supporting rod 107, and allows the first fitting portion 1093 of the left frame rotating component 109 to move relative to the left armrest supporting rod 104; thus, the left frame rotating component 109 rests against or separates from the front left limiting component 117 and thereby achieves two advantages. First, the left frame rotating component 109 can easily cause the left frame rod 101, the left armrest supporting rod 104 and the first front supporting rod 107 to move. Second, after the folding chair has been unfolded, the left frame rod 101, the left armrest supporting rod 104 and the first front supporting rod 107 are stable and sturdy.

In an embodiment of the present disclosure, as shown in FIG. 2 through FIG. 4, the left sliding component 111 has a second fitting portion 1111, a second pivotal portion 1112 and a third pivotal portion 1113. The second pivotal portion 1112 is disposed on one side of the second fitting portion 1111. The third pivotal portion 1113 is disposed at the bottom of the second fitting portion 1111. The left frame rod 101 is movably coupled to the second fitting portion 1111. One end of the left connecting rod 105 is movably coupled to the second pivotal portion 1112. One end of the left backrest rod 106 is movably coupled to the third pivotal portion 1113. Therefore, both the folding process and the unfolding process ensure smooth movement of the left frame rod 101, the left connecting rod 105 and the left backrest rod 106. Furthermore, after the folding chair has been unfolded, the left frame rod 101, the left connecting rod 105 and the left backrest rod 106 are stable and sturdy.

In an embodiment of the present disclosure, as shown in FIG. 2 through FIG. 4, the front left leg shoe 113 has a fourth pivotal portion 1131 and a fifth pivotal portion 1132. The fourth pivotal portion 1131 and the fifth pivotal portion 1132 are adjacent to each other. One end of the front left leg rod 102 is movably coupled to the fourth pivotal portion 1131. The other end of the second front supporting rod 207 is movably coupled to the fifth pivotal portion 1132. Therefore, both the folding process and the unfolding process ensure smooth movement of the front left leg rod 102 and the second front supporting rod 207. Furthermore, after the folding chair has been unfolded, the front left leg rod 102 and the second front supporting rod 207 are stable and sturdy.

In an embodiment of the present disclosure, as shown in FIG. 2 through FIG. 4, the rear left leg shoe 115 has a sixth pivotal portion 1151 and a seventh pivotal portion 1152. The sixth pivotal portion 1151 and the seventh pivotal portion 1152 are adjacent to each other. The other end of the left frame rod 101 is movably coupled to the sixth pivotal portion 1151. The other end of the second rear supporting rod 208 is movably coupled to the seventh pivotal portion 1152. Therefore, both the folding process and the unfolding process ensure smooth movement of the left frame rod 101 and the second rear supporting rod 208. Furthermore, after the folding chair has been unfolded, the left frame rod 101 and the second rear supporting rod 208 are stable and sturdy.

In an embodiment of the present disclosure, as shown in FIG. 2 through FIG. 4, the left backrest rod sliding component 116 has a third fitting portion 1161, an eighth pivotal portion 1162 and a ninth pivotal portion 1163. The eighth pivotal portion 1162 is disposed on one side of the third fitting portion 1161. The ninth pivotal portion 1163 is disposed on the other side of the third fitting portion 1161. The other end of the front left leg rod 102 is movably coupled to the eighth pivotal portion 1162. The left backrest rod 106 is movably penetratingly disposed at the third fitting portion 1161. One end of the first rear supporting rod 108 is movably coupled to the ninth pivotal portion 1163. Therefore, both the folding process and the unfolding process ensure smooth movement of the front left leg rod 102, the left backrest rod 106 and the first rear supporting rod 108. Furthermore, after the folding chair has been unfolded, the front left leg rod 102, the left backrest rod 106 and the first rear supporting rod 108 are stable and sturdy.

In an embodiment of the present disclosure, as shown in FIG. 2 and FIG. 3, the front left limiting component 117 is pivotally connected to a front left connecting rod 1171 and thus movably coupled to between the two ends of the left frame rod 101. Therefore, the front left connecting rod 1171 enhances the stability of the unfolded folding chair of the present disclosure.

In an embodiment of the present disclosure, as shown in FIG. 2 and FIG. 3, a left blocking member 1011 is disposed between the two ends of the left frame rod 101 to block the left sliding component 111. Therefore, the left blocking member 1011 enhances the stability of the unfolded folding chair of the present disclosure.

In an embodiment of the present disclosure, as shown in FIG. 2 through FIG. 4, the right frame rotating component 209 has a tenth pivotal portion 2091, a second spanning portion 2092 and a fourth fitting portion 2093. The second spanning portion 2090 is disposed on the top surface of the tenth pivotal portion 2091. The fourth fitting portion 2093 is disposed on one side of the tenth pivotal portion 2091. One end of the second front supporting rod 207 is movably coupled to the tenth pivotal portion 2091. The right frame rod 201 is movably coupled to the second spanning portion 2092. The right armrest supporting rod 204 is movably penetratingly disposed at the fourth fitting portion 2093. The fourth fitting portion 2093 rests against the front right limiting component 217. Therefore, to unfold the folding chair, the user moves the right frame rod 201 into or out of the first spanning portion 2092, uses the first pivotal portion 2091 of the right frame rotating component 209 to actuate the movement of the first front supporting rod 207, and allows the first fitting portion 2093 of the right frame rotating component 209 to move relative to the right armrest supporting rod 204; thus, the right frame rotating component 209 rests against or separates from the front right limiting component 217 and thereby achieves two advantages. First, the right frame rotating component 209 can easily cause the right frame rod 201, the right armrest supporting rod 204 and the first front supporting rod 207 to move. Second, after the folding chair has been unfolded, the right frame rod 201, the right armrest supporting rod 204 and the second front supporting rod 207 are stable and sturdy.

In an embodiment of the present disclosure, as shown in FIG. 2 through FIG. 4, the right sliding component 211 has a fifth fitting portion 2111, an eleventh pivotal portion 2112 and a twelfth pivotal portion 2113. The eleventh pivotal portion 2112 is disposed on one side of the fifth fitting portion 2111. The twelfth pivotal portion 2113 is disposed at the bottom of the fifth fitting portion 2111. The right frame rod 201 is movably coupled to the fifth fitting portion 2111. One end of the right connecting rod 205 is movably coupled to the eleventh pivotal portion 2111. One end of the right backrest rod 206 is movably coupled to the twelfth pivotal portion 2113. Therefore, both the folding process and the unfolding process ensure smooth movement of the right frame rod 201, the right connecting rod 205 and the right backrest rod 206. Furthermore, after the folding chair has been unfolded, the right frame rod 201, the right connecting rod 205 and the right backrest rod 206 are stable and sturdy.

In an embodiment of the present disclosure, as shown in FIG. 2 through FIG. 4, the front right leg shoe 213 has a thirteenth pivotal portion 2131 and a fourteenth pivotal portion 2132. The thirteenth pivotal portion 2131 and the fourteenth pivotal portion 2132 are adjacent to each other. One end of the front right leg rod 202 is movably coupled to the thirteenth pivotal portion 2131. The other end of the first front supporting rod 107 is movably coupled to the fourteenth pivotal portion 2132. Therefore, both the folding process and the unfolding process ensure smooth movement of the front right leg rod 202 and the first front supporting rod 107. Furthermore, after the folding chair has been unfolded, the front right leg rod 202 and the first front supporting rod 107 are stable and sturdy.

In an embodiment of the present disclosure, as shown in FIG. 2 through FIG. 4, the rear right leg shoe 215 has a fifteenth pivotal portion 2151 and a sixteenth pivotal portion 2152. The fifteenth pivotal portion 2151 and the sixteenth pivotal portion 2152 are adjacent to each other. The other end of the right frame rod 201 is movably coupled to the fifteenth pivotal portion 2151. The other end of the first rear supporting rod 108 is movably coupled to the sixteenth pivotal portion 2152. Therefore, both the folding process and the unfolding process ensure smooth movement of the right frame rod 201 and the first rear supporting rod 108. Furthermore, after the folding chair has been unfolded, the right frame rod 201 and the first rear supporting rod 108 are stable and sturdy.

In an embodiment of the present disclosure, as shown in FIG. 2 through FIG. 4, the right backrest rod sliding component 216 has a sixth fitting portion 2161, a seventeenth pivotal portion 2162 and an eighteenth pivotal portion 2163. The seventeenth pivotal portion 2162 is disposed on one side of the sixth fitting portion 2161. The eighteenth pivotal portion 2163 is disposed on the other side of the sixth fitting portion 2161. The other end of the front right leg rod 202 is movably coupled to the seventeenth pivotal portion 2162. The right backrest rod 206 is movably penetratingly disposed at the sixth fitting portion 2161. One end of the second rear supporting rod 208 is movably coupled to the eighteenth pivotal portion 2163. Therefore, both the folding process and the unfolding process ensure smooth movement of the front right leg rod 202, the right backrest rod 206 and the second rear supporting rod 208. Furthermore, after the folding chair has been unfolded, the front right leg rod 202, the right backrest rod 206 and the second rear supporting rod 208 are stable and sturdy.

In an embodiment of the present disclosure, as shown in FIG. 2 and FIG. 3, the front right limiting component 217 is pivotally connected to a front right connecting rod 2171 and thus movably coupled to between the two ends of the right frame rod 201. Therefore, the front right connecting rod 2171 enhances the stability of the unfolded folding chair of the present disclosure.

In an embodiment of the present disclosure, as shown in FIG. 2 and FIG. 3, a right blocking member 2011 is disposed between the two ends of the right frame rod 201 to block the right sliding component 211. Therefore, the right blocking member 2011 enhances the stability of the unfolded folding chair of the present disclosure.

While the present disclosure has been described by means of specific embodiments, numerous modifications and variations could be made thereto by those skilled in the art without departing from the scope and spirit of the present disclosure set forth in the claims.

What is claimed is:

1. A folding chair, comprising:

a left frame rod, a right frame rod, a front left leg rod, a front right leg rod, a left armrest rod, a right armrest rod, a left armrest supporting rod, a right armrest supporting rod, a left connecting rod, a right connecting rod, a left backrest rod, a right backrest rod, a first front supporting rod, a second front supporting rod, a first rear supporting rod, a second rear supporting rod, a left frame rotating component, a right frame rotating component, a left positioning slider, a right positioning slider, a left sliding component, a right sliding component, a left armrest fixing component, a right armrest fixing component, a front left leg shoe, a front right leg shoe, a left supporting rod sliding component, a right supporting rod sliding component, a rear left leg shoe, a rear right leg shoe, a left backrest rod sliding component, a right backrest rod sliding component, a front left limiting component, a front right limiting component, a seat portion and a backrest portion;

wherein the left frame rotating component is movably coupled to vicinity of an end of the left frame rod and movably coupled to the left armrest supporting rod, wherein another end of the left frame rod is movably coupled to the rear left leg shoe, wherein the left positioning slider and the left sliding component are movably coupled to between two ends of the left frame rod, wherein an end of the front left leg rod is movably coupled to the front left leg shoe, wherein another end of the front left leg rod is movably coupled to the left backrest rod sliding component, wherein the left positioning slider is movably coupled to between two ends of the front left leg rod, wherein an end of the left armrest rod is movably coupled to the left backrest rod, wherein another end of the left armrest rod is disposed at the left armrest fixing component, wherein an end of the left armrest supporting rod is movably coupled to the left armrest fixing component, wherein another end of the left armrest supporting rod is movably coupled to the left supporting rod sliding component, wherein an end of the left connecting rod is movably coupled to the left sliding component, wherein another end of the left connecting rod is movably coupled to the front left leg rod, wherein the front left leg rod is movably penetratingly disposed at the left supporting rod sliding component, wherein the left backrest rod is movably penetratingly disposed at the left backrest rod sliding component, wherein an end of the left backrest rod is movably coupled to the left sliding component, wherein the front left limiting component is disposed at the left armrest supporting rod and thus pressed against by the left frame rotating component;

wherein the right frame rotating component is movably coupled to vicinity of an end of the right frame rod and movably coupled to the right armrest supporting rod, wherein another end of the right frame rod is movably coupled to the rear right leg shoe, wherein the right positioning slider and the right sliding component are movably coupled to between two ends of the right frame rod, wherein an end of the front right leg rod is movably coupled to the front right leg shoe, wherein another end of the front right leg rod is movably coupled to the right backrest rod sliding component, wherein the right positioning slider is movably coupled to between two ends of the front right leg rod, wherein an end of the right armrest rod is movably coupled to the right backrest rod, wherein another end of the right armrest rod is disposed at the right armrest fixing component, wherein an end of the right armrest supporting rod is movably coupled to the right armrest fixing component, wherein another end of the right armrest supporting rod is movably coupled to the right supporting rod sliding component, wherein an end of the right connecting rod is movably coupled to the right sliding component, wherein another end of the right connecting rod is movably coupled to the front right leg rod, wherein the front right leg rod is movably penetratingly disposed at the right supporting rod sliding component, wherein the right backrest rod is movably penetratingly disposed at the right backrest rod sliding component, wherein an end of the right backrest rod is movably coupled to the right sliding component, wherein the front right limiting component is disposed at the right armrest supporting rod and thus pressed against by the right frame rotating component;

wherein the first front supporting rod and the second front supporting rod cross each other and are movably coupled together, wherein an end of the first front supporting rod is movably coupled to the left frame rotating component, wherein another end of the first front supporting rod is movably coupled to the front right leg shoe, wherein an end of the second front supporting rod is movably coupled to the right frame rotating component, wherein another end of the second front supporting rod is movably coupled to the front left leg shoe;

wherein the first rear supporting rod and the second rear supporting rod cross each other and are movably coupled together, wherein an end of the first rear supporting rod is movably coupled to the left backrest rod sliding component, wherein another end of the first rear supporting rod is movably coupled to the rear right leg shoe, wherein an end of the second rear supporting rod is movably coupled to the right backrest rod sliding component, wherein another end of the second rear supporting rod is movably coupled to the rear left leg shoe; and wherein the seat portion is disposed at the left frame rod and the right frame rod, wherein the backrest portion is disposed at the left backrest rod and the right backrest rod.

2. The folding chair of claim 1, wherein the left frame rotating component has a first pivotal portion, a first spanning portion and a first fitting portion, wherein the first spanning portion is disposed at a top surface of the first pivotal portion, wherein the first fitting portion is disposed on a side of the first pivotal portion, wherein an end of the first front supporting rod is movably coupled to the first pivotal portion, wherein the left frame rod is movably coupled to the first spanning portion, wherein the left armrest supporting rod is movably penetratingly disposed at the first fitting portion, wherein and the first fitting portion rests against the front left limiting component.

3. The folding chair of claim 1, wherein the left sliding component has a second fitting portion, a second pivotal portion and a third pivotal portion, wherein the second pivotal portion is disposed on a side of the second fitting portion, wherein the third pivotal portion is disposed at a bottom of the second fitting portion, wherein the left frame rod is movably coupled to the second fitting portion, wherein an end of the left connecting rod is movably coupled to the second pivotal portion, wherein an end of the left backrest rod is movably coupled to the third pivotal portion.

4. The folding chair of claim 1, wherein the front left leg shoe has a fourth pivotal portion and a fifth pivotal portion, wherein the fourth pivotal portion and the fifth pivotal portion are adjacent to each other, wherein an end of the front left leg rod is movably coupled to the fourth pivotal portion, wherein another end of the second front supporting rod is movably coupled to the fifth pivotal portion.

5. The folding chair of claim 1, wherein the rear left leg shoe has a sixth pivotal portion and a seventh pivotal portion, wherein the sixth pivotal portion and the seventh pivotal portion are adjacent to each other, wherein another end of the left frame rod is movably coupled to the sixth pivotal portion, wherein another end of the second rear supporting rod is movably coupled to the seventh pivotal portion.

6. The folding chair of claim 1, wherein the left backrest rod sliding component has a third fitting portion, an eighth pivotal portion and a ninth pivotal portion, wherein the eighth pivotal portion is disposed on a side of the third fitting portion, wherein the ninth pivotal portion is disposed on another side of the third fitting portion, wherein another end of the front left leg rod is movably coupled to the eighth pivotal portion, wherein the left backrest rod is movably penetratingly disposed at the third fitting portion, wherein an end of the first rear supporting rod is movably coupled to the ninth pivotal portion.

7. The folding chair of claim 1, wherein the front left limiting component is pivotally connected to a front left connecting rod and thus movably coupled to between two ends of the left frame rod.

8. The folding chair of claim 1, wherein a left blocking member is disposed between two ends of the left frame rod to block the left sliding component.

9. The folding chair of claim 1, wherein the right frame rotating component has a tenth pivotal portion, a second spanning portion and a fourth fitting portion, wherein the second spanning portion is disposed on a top surface of the tenth pivotal portion, wherein the fourth fitting portion is disposed on a side of the tenth pivotal portion, wherein an end of the second front supporting rod is movably coupled to the tenth pivotal portion, wherein the right frame rod is movably coupled to the second spanning portion, wherein the right armrest supporting rod is movably penetratingly disposed at the fourth fitting portion, wherein and the fourth fitting portion rests against the front right limiting component.

10. The folding chair of claim 1, wherein the right sliding component has a fifth fitting portion, an eleventh pivotal portion and a twelfth pivotal portion, wherein the eleventh pivotal portion is disposed on a side of the fifth fitting portion, wherein the twelfth pivotal portion is disposed at a bottom of the fifth fitting portion, wherein the right frame rod is movably coupled to the fifth fitting portion, wherein an end of the right connecting rod is movably coupled to the eleventh pivotal portion, wherein an end of the right backrest rod is movably coupled to the twelfth pivotal portion.

11. The folding chair of claim 1, wherein the front right leg shoe has a thirteenth pivotal portion and a fourteenth pivotal portion, wherein the thirteenth pivotal portion and the fourteenth pivotal portion are adjacent to each other, wherein an end of the front right leg rod is movably coupled to the thirteenth pivotal portion, wherein another end of the first front supporting rod is movably coupled to the fourteenth pivotal portion.

12. The folding chair of claim 1, wherein the rear right leg shoe has a fifteenth pivotal portion and a sixteenth pivotal portion, wherein the fifteenth pivotal portion and the sixteenth pivotal portion are adjacent to each other, wherein another end of the right frame rod is movably coupled to the fifteenth pivotal portion, wherein another end of the first rear supporting rod is movably coupled to the sixteenth pivotal portion.

13. The folding chair of claim 1, wherein the right backrest rod sliding component has a sixth fitting portion, a seventeenth pivotal portion and an eighteenth pivotal portion, wherein the seventeenth pivotal portion is disposed on a side of the sixth fitting portion, wherein the eighteenth pivotal portion is disposed on another side of the sixth fitting portion, wherein another end of the front right leg rod is movably coupled to the seventeenth pivotal portion, wherein the right backrest rod is movably penetratingly disposed at the sixth fitting portion, wherein an end of the second rear supporting rod is movably coupled to the eighteenth pivotal portion.

14. The folding chair of claim 1, wherein the front right limiting component is pivotally connected to a front right connecting rod and thus movably coupled to between two ends of the right frame rod.

15. The folding chair of claim 1, wherein a right blocking member is disposed between two ends of the right frame rod to block the right sliding component.

16. The folding chair of claim 1, wherein the backrest portion and the seat portion are connected.

* * * * *